US006851242B1

(12) United States Patent
Weatherston

(10) Patent No.: US 6,851,242 B1
(45) Date of Patent: Feb. 8, 2005

(54) RAISED GARDEN BLOCK

(76) Inventor: John Weatherston, 333 Millwood, Roseville, MN (US) 55133

( * ) Notice: Subject to any disclaimer, the term of this patent is extended or adjusted under 35 U.S.C. 154(b) by 218 days.

(21) Appl. No.: 10/190,426

(22) Filed: Jul. 3, 2002

Related U.S. Application Data

(60) Provisional application No. 60/303,548, filed on Jul. 6, 2001.

(51) Int. Cl.[7] ..... E04B 5/04

(52) U.S. Cl. ..... 52/596; 405/284; 52/604

(58) Field of Search ..... 52/603, 604, 605, 52/606, 596; 47/83, 85, 86; 405/284, 286, 287, 262; 446/73, 76, 117

(56) References Cited

U.S. PATENT DOCUMENTS 2,141,035 A * 12/1938 Daniels ..... 202/223
3,478,482 A * 11/1969 Weir ..... 52/592.3
4,385,088 A 5/1983 Baskin
4,565,043 A * 1/1986 Mazzarese ..... 52/592.6
5,161,918 A * 11/1992 Hodel ..... 405/286
5,224,801 A 7/1993 Quaney
5,294,216 A * 3/1994 Sievert ..... 405/286
5,568,999 A 10/1996 Egan et al.
5,601,384 A * 2/1997 Dawson ..... 405/284
5,851,088 A 12/1998 Anderson et al.

* cited by examiner

*Primary Examiner*—Peter M. Cuomo
*Assistant Examiner*—Stephen Vu
(74) *Attorney, Agent, or Firm*—Sherrill Law Offices, PLLC; Elizabeth D. Lewen

(57) ABSTRACT

An interlocking hollow body configured and arranged with integrally formed and partially laterally overlapped upper and lower generally rectangular sections which form (a) a central commons portion, (b) a cantilevered portion of the upper section projecting from a first side of the body, and (c) a cantilevered portion of the lower section projecting from a second side of the body. The body has (i) a decorative front surface on the upper and lower sections, (ii) a rear surface on the upper and lower sections, (iii) laterally offset first ends on the upper and lower sections, (iv) laterally offset second ends on the upper and lower sections, (v) an underside of the upper section between the laterally offset first ends on the upper and lower sections, and (vi) a top of the lower section between the laterally offset second ends on the upper and lower sections. A protrusion projects from either the underside of the upper section or the top of the lower section. An aperture mated to the protrusion is provided on the other surface for accepting the protrusion from another block and thereby permitting the interlocking of multiple blocks.

7 Claims, 6 Drawing Sheets

RAISED GARDEN BLOCK

This application claims the benefit of provisional patent application Ser. No. 60/303,548 filed Jul. 6, 2001, abandoned.

FIELD OF THE INVENTION

The invention relates to retaining walls. More specifically, the invention relates to retaining wall block useful in the construction of a raised garden.

BACKGROUND

Raised gardens are a common sight in Europe and are becoming more prevalent in the United States. Raised gardens enhance the beauty of a lawn and simplify care of the garden as the gardener need not bend quite as far to stake the flowers, pick the vegetables, prune the shrubs, and pull the weeds growing in the garden.

Traditional materials used to form the wall of a raised garden include, landscape timbers, stone, brick and retaining wall block. These materials, while effective for forming the walls of a raised garden, are heavy, expensive and require substantial time and effort to install.

Hence, a substantial need exists for an inexpensive and lightweight article capable of quick and easy assembly to form the walls of a raised garden.

SUMMARY OF THE INVENTION

One embodiment of my interlocking block is a hollow body configured and arranged with integrally formed and partially laterally overlapped upper and lower generally rectangular sections which form (a) a central commons portion, (b) a cantilevered portion of the upper section projecting from a first side of the body, and (c) a cantilevered portion of the lower section projecting from a second side of the body. The block has (i) a decorative front surface on the upper and lower sections, (ii) a rear surface on the upper and lower sections, (iii) a top defined by the upper section, (iv) a bottom defined by the lower section, (v) laterally offset first ends on the upper and lower sections, (vi) laterally offset second ends on the upper and lower sections, (vii) an underside of the upper section between the laterally offset first ends on the upper and lower sections, and (viii) a top of the lower section between the laterally offset second ends on the upper and lower sections. A protrusion projects upward from the top of the lower section, and an aperture is provided in the underside of the upper section for accepting the protrusion from another block so as to interlock the blocks. Alternatively the protrusion can project downward from the underside of the upper section with the aperture provided in the top of the lower section.

The blocks can be used to form a raised garden by simply (a) obtaining at least four of the blocks, (b) interlocking the blocks to form a completely enclosed area by placing the protrusion of each block into the aperture of another block, and (c) filling the enclosed area with dirt suitable for growing plants.

DETAILED DESCRIPTION OF THE INVENTION INCLUDING A BEST MODE

Nomenclature

Figure 1:
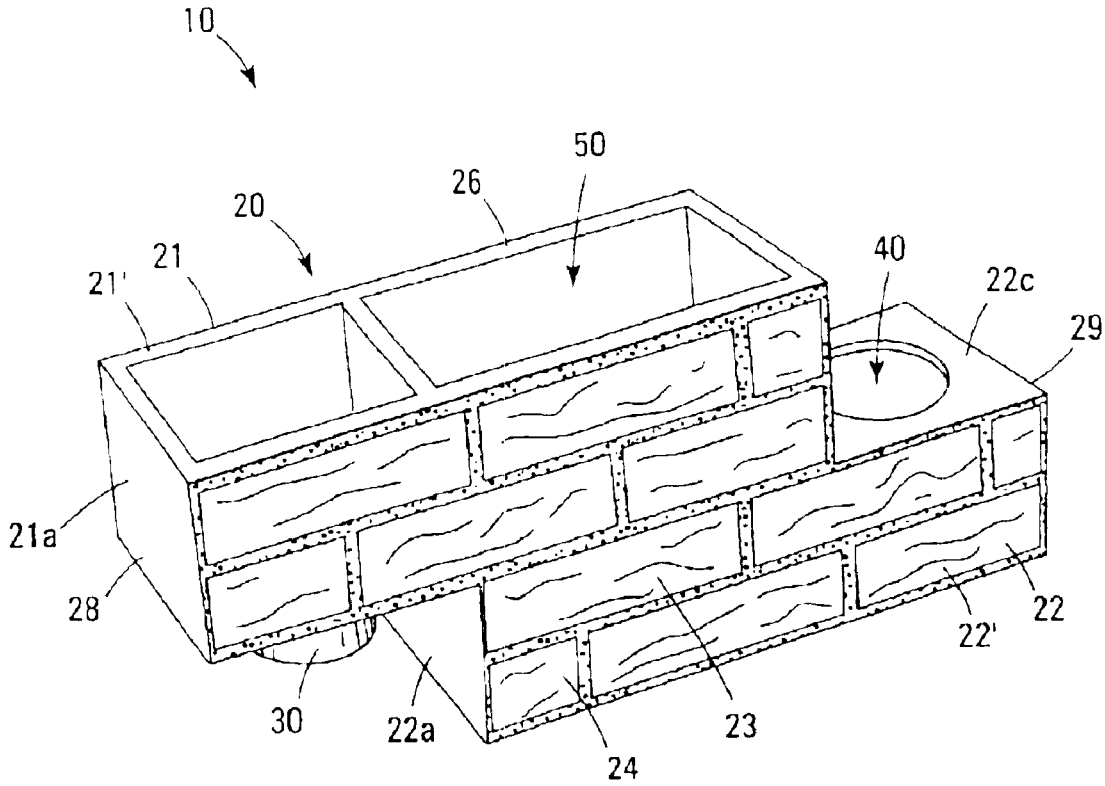
FIG. 1 is an upper front left perspective view of one embodiment of the invention.

10 Block
20 Body
21 Upper Section
21' Cantilevered Portion of Upper Section
**21*a*** First End of Upper Section
**21*b*** Second End of Upper Section
**21*c*** Underside of Upper Section
22 Lower Section
22' Cantilevered Portion of Lower Section
**22*a*** First End of Lower Section
**22*b*** Second End of Lower Section
**22*c*** Top of Lower Section
23 Central Commons Portion
24 Front Surface
25 Rear Surface
26 Top
27 Bottom
28 First Side of Body
29 Second Side of Body
30 Protrusion
40 Aperture
50 Interior Chamber of Block
62 Drain Hole Definitions As utilized herein, including the claims, the phrase "lightweight concrete masonry" refers to a concrete masonry made with a lightweight aggregate.

Construction

The block 10 is a hollow, lightweight, inexpensive, body 20 configured and arranged with integrally formed and partially laterally overlapped upper 21 and lower 22 generally rectangular sections. The upper 21 and lower 22 rectangular sections form a central commons portion 23, a cantilevered portion 21' of the upper section 21 projecting from a first side 28 of the body 20, and a cantilevered portion 22' of the lower section 22 projecting from a second side 29 of the body 20.

The block 10 has (i) a decorative front surface 24 (e.g., appearance of brick, flagstone, marble, etc.) on the upper 21 and lower 22 sections, (ii) a rear surface 25 on the upper 21 and lower 22 sections, (iii) a top 26 defined by the upper section 21, (iv) a bottom 27 defined by the lower section 22, (v) laterally offset first ends **21*a* and 22*a* on the upper 21 and lower 22 sections respectively, (vi) laterally offset second ends 21*b* and 22*b* on the upper 21 and lower 22 sections respectively, (vii) an underside 21*c* of the upper section 21 between the laterally offset first ends 21*a* and 22*a* on the upper 21 and lower 22 sections, and (viii) a top 22*c* on the lower section 22 between the laterally offset second ends 21*b* and 22*b* on the upper 21 and lower 22** sections respectively.

The blocks 10 may have a lateral length (not numbered) of about 1 to 4 feet. The longitudinal height (not numbered) of the blocks 10 may be about 8 inches to 3 feet. The transverse depth (not numbered) may be about 6 inches to 3 feet.

Figure 3:
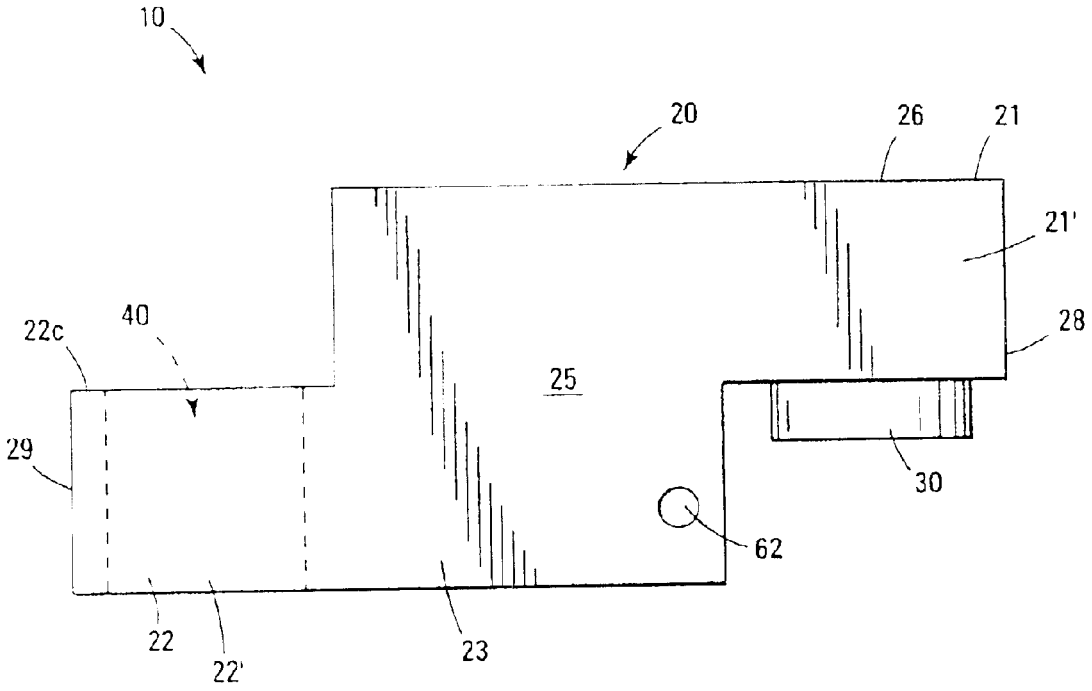
FIG. 3 is a rear view of the invention shown in FIGS. 1 and 2.

As shown in FIG. 3, drainage holes 62 can be provided in the rear 25 of the body 20.

Figure 2:
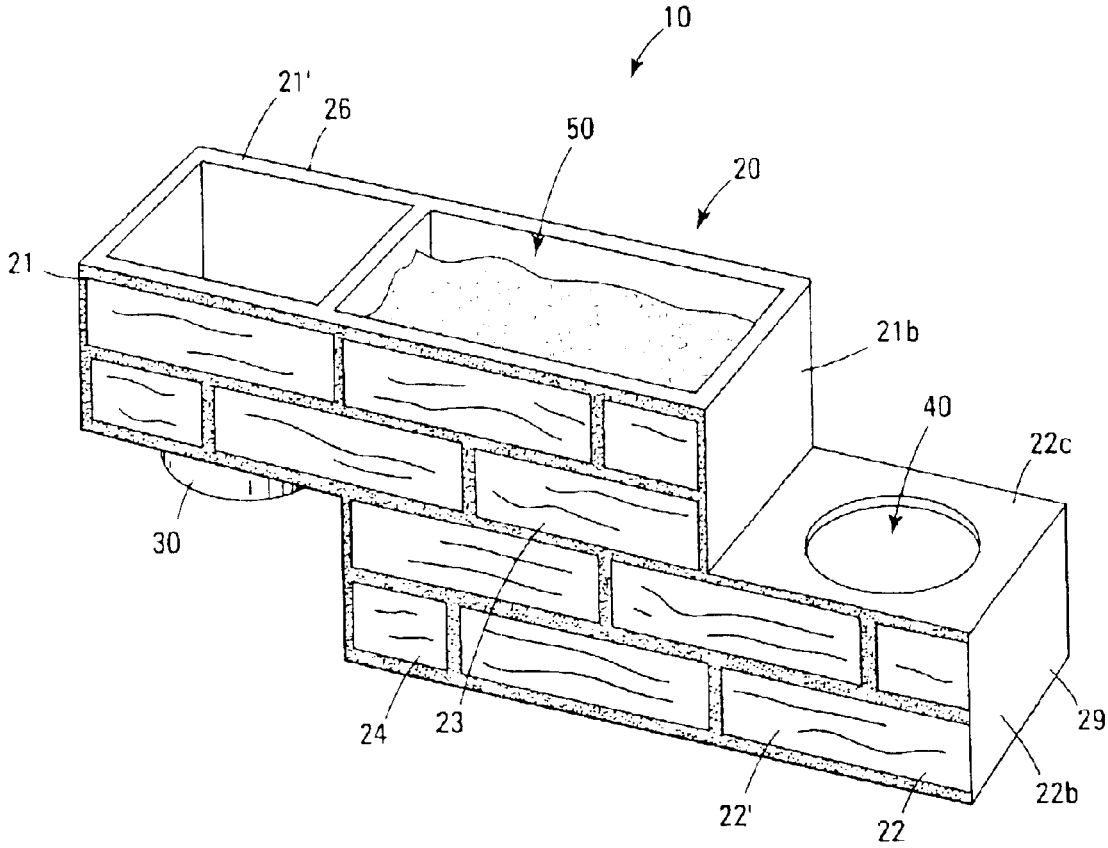
FIG. 2 is an upper front right perspective view of the invention in FIG. 1 with dirt in the block.
Figure 4:
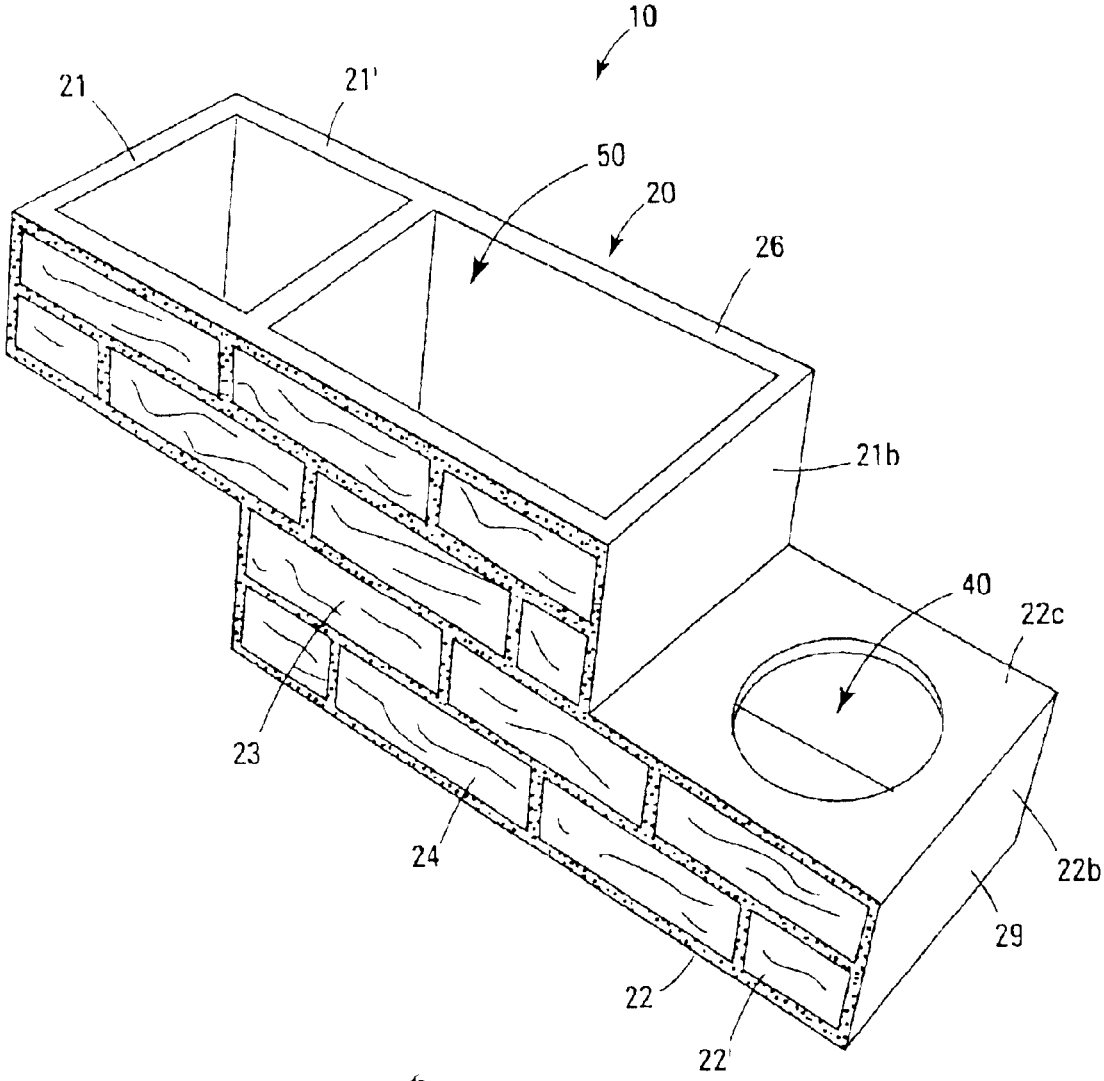
FIG. 4 is an upper front right perspective view of the invention shown in FIG. 2 without the dirt.
Figure 5:
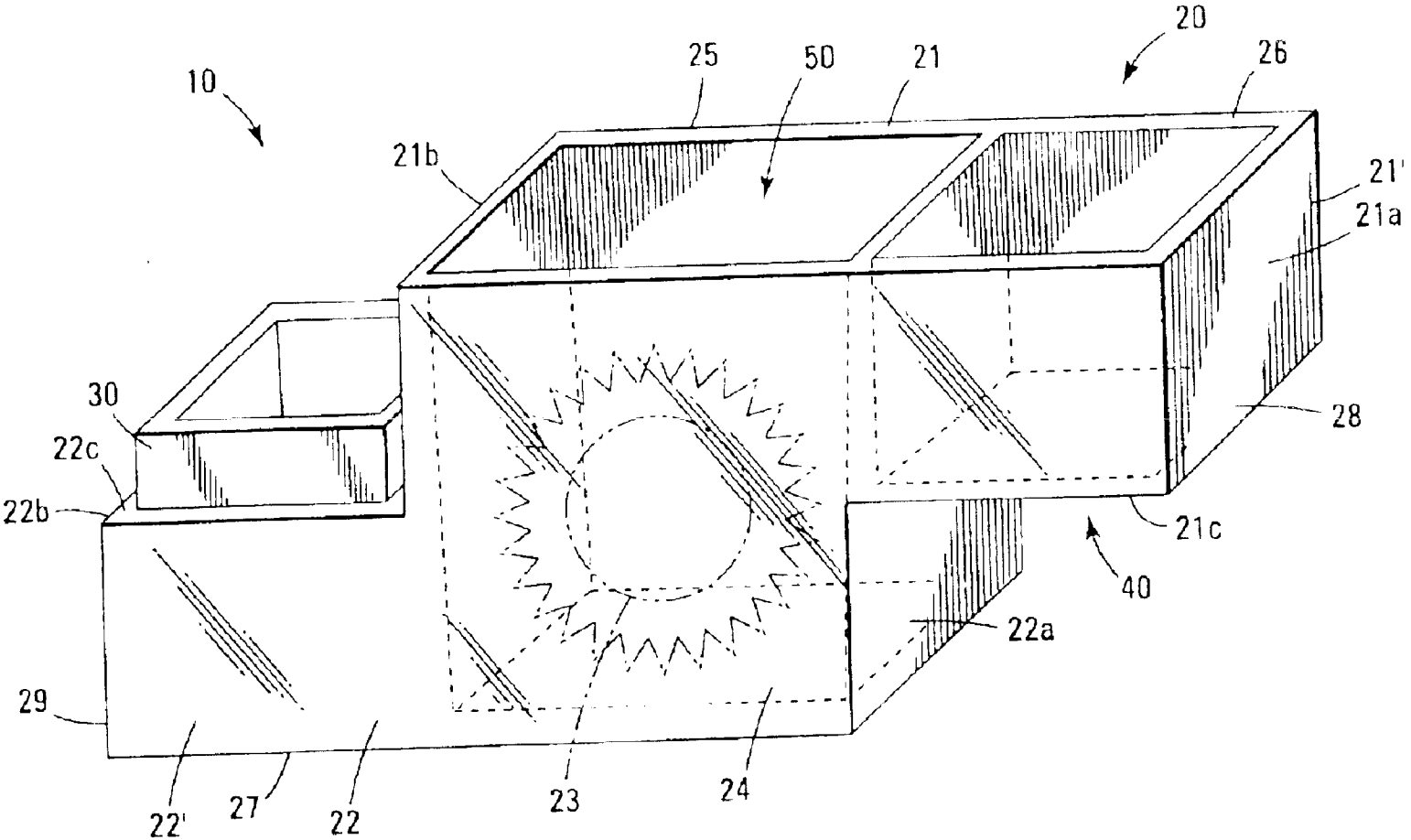
FIG. 5 is an upper front right perspective view of a second embodiment of the invention.

As shown in FIGS. 1 and 2, a protrusion 30 projects downward from the underside 21*c* of the upper section 21. As shown in FIG. 4, an aperture 40 is provided in the top 22*c* of the lower section 22 configured and arranged to mate with a protrusion 30 on another block 10 so as to interlock the blocks 10. Alternatively, as shown in FIG. 5, the protrusion 30 can project upward from the top 22*c* of the lower section 22 with the aperture 40 provided in the underside 21*c* of the upper section 21.

The periphery (unnumbered) of the bottom 27 of the lower section 22 can be provided with integrally formed, downward extending spikes (not shown) for preventing the blocks 10 from shifting during assembly and use of a raised garden constructed from the blocks 10. Alternatively, a plurality of horizontal tabs (not shown) and/or downwardly angled apertures (not shown) can be provided proximate the periphery (unnumbered) of the bottom 27 of the lower section 22 through which stabilizing stakes (not shown) can be driven to prevent shifting of the blocks 10.

The top 26 of the body 20 can optionally be provided with the hardware (not shown) necessary to accommodate the mounting and connection of yard lighting (not shown) and/or sprinklers (not shown). One such option involves the incorporation of a ½ inch threaded male or female fitting (not shown) in the top 26 of the body 20. The bore (not shown) of the fitting (not shown) can be closed to prevent access to the interior chamber 50 or open to allow electrical wiring (not shown) or water lines (not shown) to be run through the interior chamber 50 and into communication with a yard light (not shown) or sprinkler head (not shown) mounted on the fitting (not shown).

The blocks 10 can be made from a wide variety of castable materials, including specifically, but not exclusively, plastic, concrete masonry, and lightweight concrete masonry. A preferred material is lightweight concrete masonry.

Use

Figure 6:
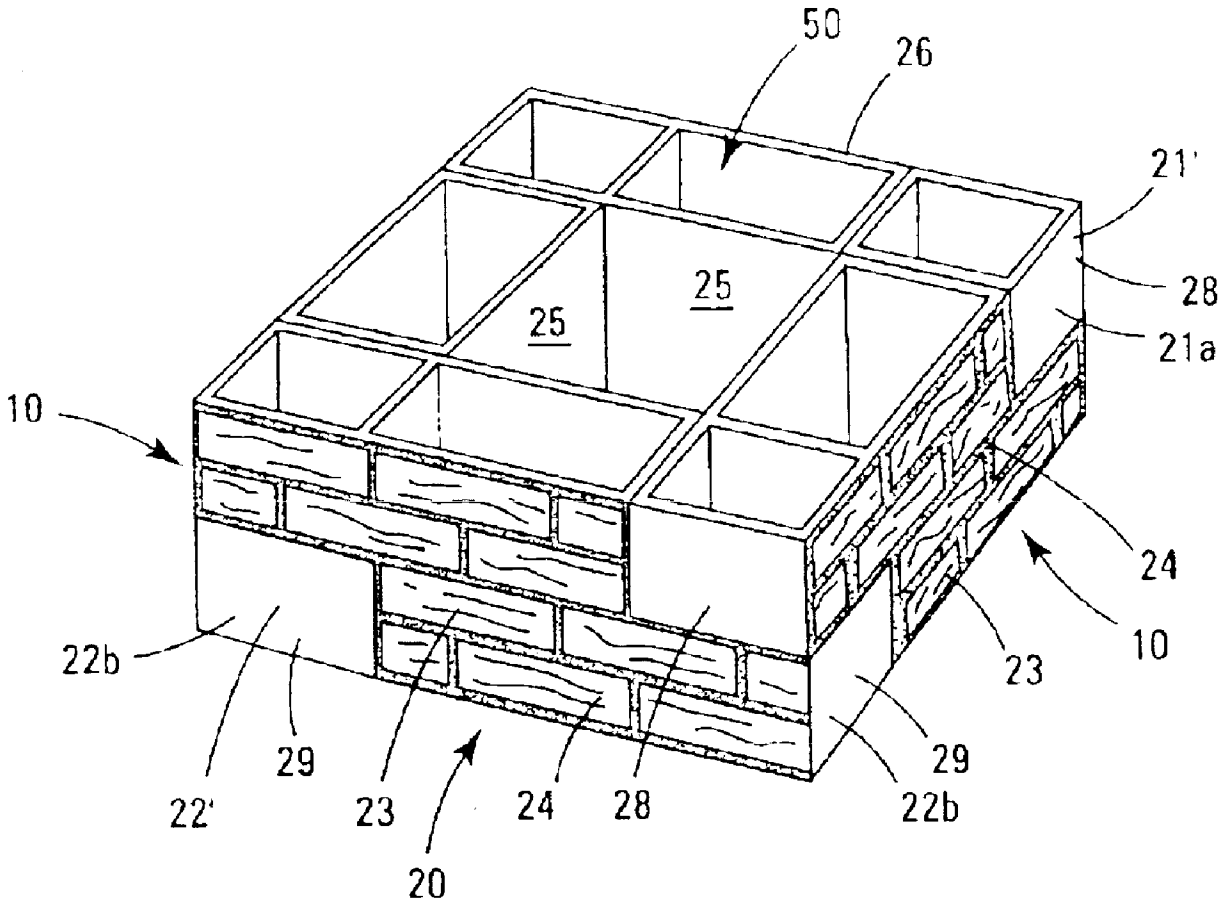
FIG. 6 is a perspective view of 4 blocks of the invention interconnected to form a raised garden wherein the decorative appearance of the first side and the second side of the body has been removed to facilitate viewing.

As shown in FIG. 6, the blocks 10 can be used to form a raised garden (not shown) by simply (a) obtaining at least four of the blocks 10, (b) interlocking the blocks 10 to form a completely enclosed area by placing the protrusion 30 of each block 10 into the aperture 40 of another block 10, and (c) filling the enclosed area with dirt (not shown) suitable for growing plants (not shown).

I claim:

1. An interlocking block, comprising:

(a) a hollow body configured and arranged with integrally formed and partially laterally overlapped upper and lower generally rectangular sections having (i) a central commons portion, (ii) a cantilevered portion of the upper section projecting from a first side of the body, (iii) a cantilevered portion of the lower section projecting from a second side of the body, (iv) a decorative front surface on the upper and lower sections, (v) a rear surface on the upper and lower sections, (vi) a top defined by the upper section, (vii) a bottom defined by the lower section, (viii) laterally offset first ends on the upper and lower sections, (ix) laterally offset second ends on the upper and lower sections, (x) an underside of the upper section between the laterally offset first ends on the upper and lower sections, and (xi) a top of the lower section between the laterally offset second ends on the upper and lower sections;

(b) a protrusion projecting upward from the top of the lower section; and (c) an aperture in the underside of the upper section configured and arranged to accept the protrusion projecting upward from the top of the lower section of a second body so as to permit interlocking of the bodies.

2. The interlocking block of claim 1, wherein the first and second rectangular sections are substantially the same size and shape.

3. The interlocking block of claim 1, wherein the cantilevered portion of the upper section and the cantilevered portion of the lower section extend substantially the same lateral distance from the central commons portion.

4. The interlocking block of claim 1, wherein the block has (i) a lateral length of about 1 to 4 feet, (ii) a longitudinal height of about 8 inches to 3 feet, and (iii) a transverse depth of about 6 inches to 3 feet.

5. The interlocking block of claim 1, wherein the block is constructed of concrete masonry.

6. The interlocking block of claim 1, wherein the block is constructed of lightweight concrete masonry.

7. A method of forming a raised garden, comprising:

(a) obtaining at least four of an interlocking block, comprising, (i) a hollow body configured and arranged with integrally formed and partially laterally overlapped upper and lower generally rectangular sections having (1) a central commons portion, (2) a cantilevered portion of the upper section projecting from a first side of the body, (3) a cantilevered portion of the lower section projecting from a second side of the body, (4) a decorative front surface on the upper and lower sections, (5) a rear surface on the upper and lower sections, (6) a top defined by the upper section, (7) a bottom defined by the lower section, (8) laterally offset first ends on the upper and lower sections, (9) laterally offset second ends on the upper and lower sections, (10) an underside of the upper section between the laterally offset first ends on the upper and lower sections, and (11) a top of the lower section between the laterally offset second ends on the upper and lower sections, (ii) a protrusion projecting upward from the top of the lower section, and (iii) an aperture in the underside of the upper section configured and arranged to accept the protrusion projecting upward from the top of the lower section of a second body so as to permit interlocking of the bodies;

(b) interlocking the blocks to form a completely enclosed area by placing the protrusion of each block into the aperture of another block; and (c) filling the enclosed area with dirt suitable for growing plants.

* * * * *